US010940874B2

(12) United States Patent
Schmid et al.

(10) Patent No.: US 10,940,874 B2
(45) Date of Patent: Mar. 9, 2021

(54) MAINTENANCE VEHICLE AND METHOD

(71) Applicant: ROBEL BAHNBAUMASCHINEN GMBH, Freilassing (DE)

(72) Inventors: Gregor Schmid, Ainring (DE); Christoph Muehlbacher, Teisendorf (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 213 days.

(21) Appl. No.: 16/068,906

(22) PCT Filed: Dec. 6, 2016

(86) PCT No.: PCT/EP2016/002048
§ 371 (c)(1),
(2) Date: Jul. 10, 2018

(87) PCT Pub. No.: WO2017/121441
PCT Pub. Date: Jul. 20, 2017

(65) Prior Publication Data

US 2019/0016350 A1 Jan. 17, 2019

(30) Foreign Application Priority Data

Jan. 14, 2016 (DE) ..... 10 2016 000 408

(51) Int. Cl.

| | |
|---|---|
| ***E01B 15/00*** | (2006.01) |
| ***B61D 15/00*** | (2006.01) |
| ***E01B 29/16*** | (2006.01) |
| ***E01B 31/02*** | (2006.01) |

(52) U.S. Cl.
CPC ..... *B61D 15/00* (2013.01); *E01B 29/16* (2013.01); *E01B 31/02* (2013.01)

(58) Field of Classification Search
CPC ..... E01B 29/00; E01B 29/02; E01B 29/04; E01B 29/16; E01B 29/24; E01B 29/32; E01B 31/00; E01B 31/02; E01B 31/20; E01B 33/00; E01B 37/00
See application file for complete search history.

(56) References Cited

U.S. PATENT DOCUMENTS

| | | | | |
|---|---|---|---|---|
| 5,113,767 | A | 5/1992 | Theurer | |
| 6,787,726 | B2 * | 9/2004 | Thelen | B23K 9/0026 219/54 |
| 10,808,363 | B2 | 10/2020 | Hechenberger | |

(Continued)

FOREIGN PATENT DOCUMENTS

| | | | |
|---|---|---|---|
| AU | 2005282006 | B2 | 3/2006 |
| AU | 2011260627 | B2 | 12/2011 |

(Continued)

*Primary Examiner* — Robert J McCarry, Jr.
(74) *Attorney, Agent, or Firm* — Laurence A. Greenberg; Werner H. Sterner; Ralph E. Locher

(57) ABSTRACT

A maintenance vehicle has side walls for creating a work space, delimited by the same, for working personnel situated on a track. The side walls are arranged on a vehicle frame and configured to be distanced from one another in a transverse direction of the vehicle. For treatment of a track section situated within the work space, an industrial robot is arranged on the vehicle, having at least three motion axes, media couplings for energy supply as well as a tool coupling for selective connection to a track treatment tool.

12 Claims, 1 Drawing Sheet

(56) References Cited

U.S. PATENT DOCUMENTS

| | | | | |
|---|---|---|---|---|
| 2002/0148378 | A1 | 10/2002 | Theurer | |
| 2004/0144282 | A1 | 7/2004 | Huwer | |
| 2011/0274232 | A1 | 11/2011 | Doll | |
| 2012/0192756 | A1* | 8/2012 | Miller | B61L 23/048 104/2 |

FOREIGN PATENT DOCUMENTS

| | | | |
|---|---|---|---|
| CA | 2748966 | A1 | 4/2011 |
| CN | 1270027 | C | 8/2006 |
| CN | 1989037 | A | 6/2007 |
| CN | 202318314 | U | 7/2012 |
| CN | 102933768 | A | 2/2013 |
| DE | 9206335 | U1 | 9/1992 |
| DE | 20208835 | U1 | 11/2002 |
| DE | 202004013732 | U1 | 1/2005 |
| DE | 202009014493 | U1 | 3/2010 |
| DE | 102010022679 | A1 | 12/2011 |
| DE | 202012002222 | U1 | 6/2012 |
| DE | 202016000509 | U1 | 4/2016 |
| GB | 1166876 | A | 10/1969 |
| GB | 2298885 | A | 9/1996 |
| JP | H0771002 | A | 3/1995 |
| JP | H08258709 | A | 10/1996 |
| JP | 2008511484 | A | 4/2008 |
| JP | 2011089262 | A | 5/2011 |
| JP | 2013528725 | A | 7/2013 |
| NO | 20030085 | L | 7/2003 |
| WO | 2011054410 | A2 | 5/2011 |

* cited by examiner

Fig. 1
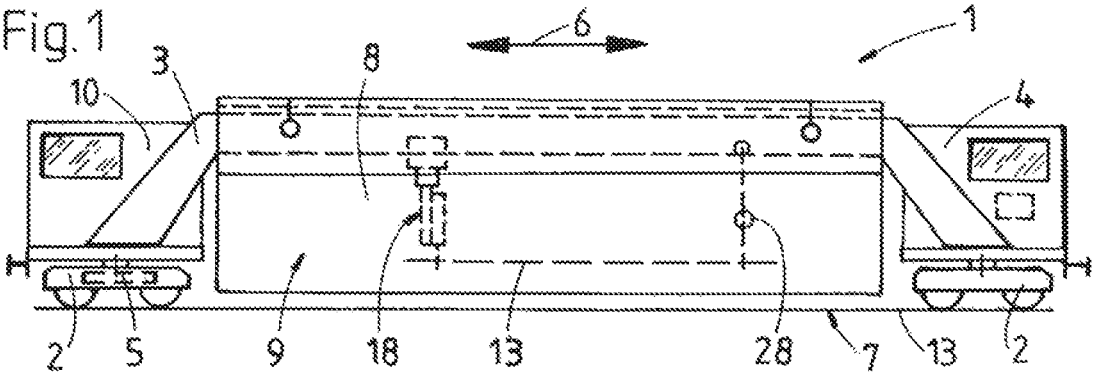
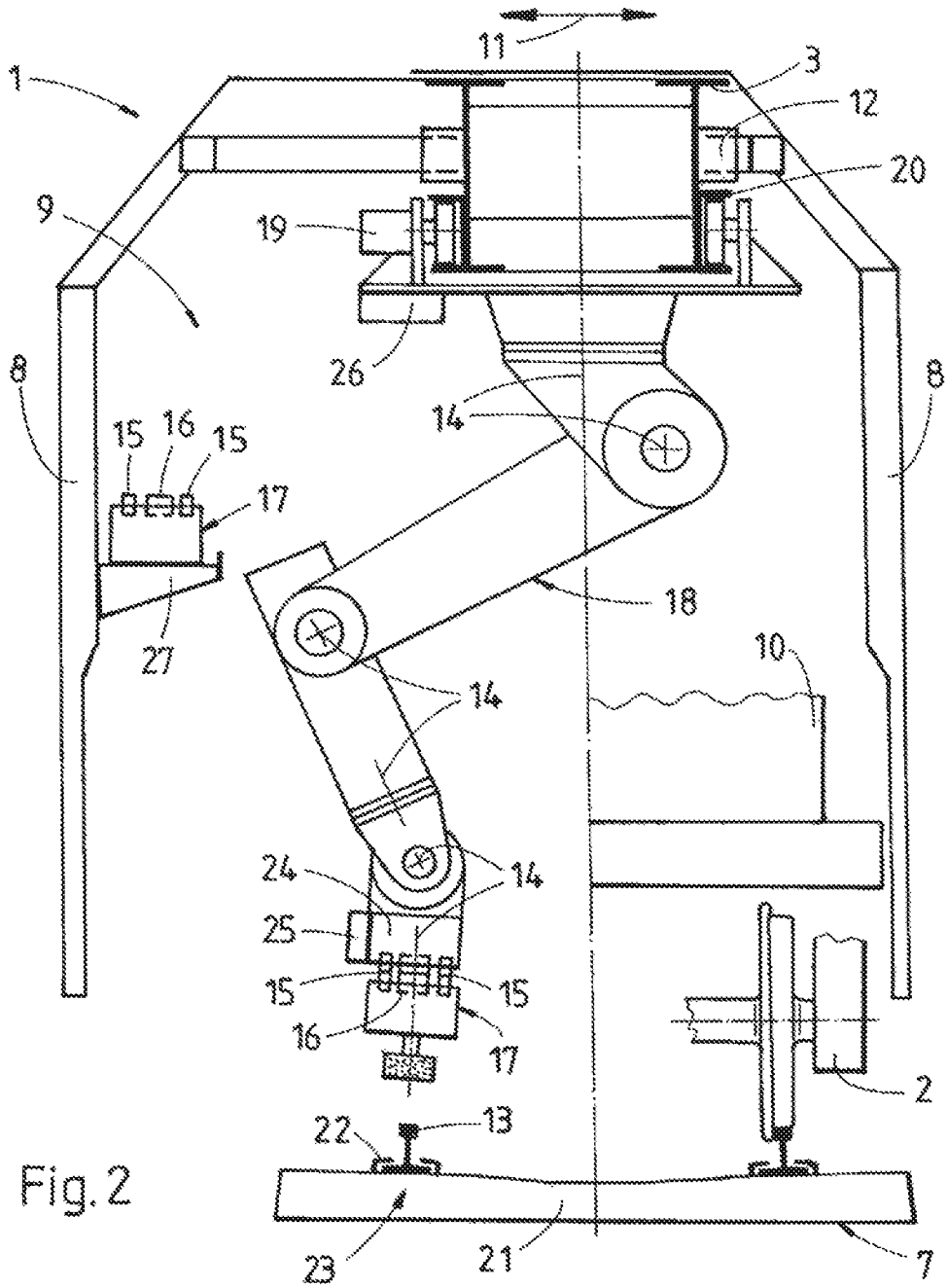
Fig. 2

MAINTENANCE VEHICLE AND METHOD

BACKGROUND OF THE INVENTION

Field of the Invention

The invention relates to a maintenance vehicle and a method of carrying out maintenance operations on a section of a track according to the features cited in the introductory part of the main claims, respectively.

Known according to DE 20 2004 013 732 U1 is a maintenance vehicle including a work space open towards the track. The upper end region of the work space in vertical direction is formed by an upwardly recessed vehicle frame so that working personnel can work on the track without hindrance between two side walls in a secured area.

On a further track work vehicle disclosed in DE 92 06 335 U1, an articulatedly designed jib is installed in the region of a bridge-shaped chassis wherein, with the aid of said jib, a tool arranged thereon can be positioned in a section of terrain situated next to the track.

SUMMARY OF THE INVENTION

It is the object of the present invention to provide a maintenance vehicle of the type mentioned at the beginning with which an improved track treatment is possible.

According to the invention, this object is achieved by way of the inventive features cited in the characterizing part of the main claims.

Equipping the work space in this manner enables a complete relief of the working personnel from physical stress resulting from the manipulation of the track treatment tool. Furthermore, the accuracy of the work result can be increased due to a precise guidance by the robot. With the energy supply by way of the media couplings, the use of noisy combustion engines producing exhaust gases also becomes superfluous.

Due to the possibility of containing various track treatment tools in the work space, it is possible to cover to a large extent all work required for complete track maintenance. The use of a worker can be restricted essentially to controlling functions. In connection with scanning the track components to be worked on, on the one hand a precise operation of the track treatment tool is ensured and, on the other hand, also a finalising documentation of the work result is possible.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing.

FIG. 1 shows a simplified side view of a maintenance vehicle, and

FIG. 2 shows an enlarged cross-section of the maintenance vehicle forming a work space.

DESCRIPTION OF THE INVENTION

A maintenance vehicle 1 shown in FIG. 1 has a vehicle frame 3, supported at the ends on on-track undercarriages 2, and a driver's cabin 4. With the aid of a motive drive 5, the vehicle 1 is mobile on a track 7 in a longitudinal direction 6 of the vehicle. The vehicle frame 3 is designed to be upwardly recessed between the two on-track undercarriages 2, whereby a work space 9 is delimited between two side walls 8 (see FIG. 2) which is open in the direction towards the track 7 but otherwise closed in itself for safety reasons. Said work space 9 is accessible from a crew cabin 10, so that workers busy in the work space 9 are not required to dwell in a danger area situated outside the maintenance vehicle 1.

As visible in FIG. 2, two side walls 8 are provided which can be distanced from one another by means of a drive 12 in a transverse direction 11 of the vehicle extending perpendicularly to the longitudinal direction 6 of the vehicle. In the example shown, for providing an enlarged work space 9, only the side wall 8 on the left is displaced in the transverse direction 11 of the vehicle, so that a left-hand rail 13 of the track 7 can be worked on without hindrance. If needed, it is possible to additionally displace also the opposite, right-hand side wall 8 in the transverse direction 11 of the vehicle relative to the vehicle frame 3 for further enlargement of the work space 9.

For treatment of a section of the track 7 lying within the work space 9, an industrial robot 18 is arranged on the vehicle 1, the robot having at least three motion axes 14 and media couplings 15 for energy supply as well as a tool coupling 16 for selective connection to a track treatment tool 17 (in FIG. 2 a rail grinder, for example). Said industrial robot 18 is mounted for displacement by means of a drive 19 on a robot guide 20 which extends in the longitudinal direction 6 of the vehicle and is fastened to the vehicle frame 3.

For contact-less scanning of track components 23 which are accessible within the work space 9 and are composed of the rails 13, sleepers 21 and rail fastenings 22, the industrial robot 18 is equipped with sensors 25 at an end 24 at the coupling side. A control device 26 associated with the industrial robot 18 is designed, in addition to the robot control, for storing parameters detected by the sensors 25 and characterizing the work quality of the track components 23 treated by the robot 18.

The industrial robot 18 is configured for automatic coupling to the track treatment tool 17, stored for selection on a tool shelf 27 inside the work space 9, as well as for the automatic energy supply thereof by the media couplings 15 and for a subsequent work assignment taking place automatically in a selectable program mode. If needed, it is also possible to automatically control via the control device 26 a combined work effort of the industrial robot 18 with a spring balancer 28 displaceable on the vehicle frame 3 in the longitudinal direction 6 of the vehicle (see FIG. 1), particularly for installing or removing the rails 13. Thus, handling of heavy rail parts is facilitated by the industrial robot 18.

For implementing maintenance operations, the vehicle 1 is stopped on a track section to be treated, and the work space 9 required for unhindered working on the track components 23 is created by displacement of the two side walls 8. For a scheduled work operation of the industrial robot 18, after inputting a corresponding code into the control device 26, the appropriate track treatment tool 17 is selected from a group of tools, pre-stored on the tool shelf 27 in the work space 9, and automatically coupled—both mechanically as well as with regard to a complete energy supply—to the industrial robot 18.

The track component 23 to be treated by the track treatment tool 17 is then contact-less scanned with the aid of the sensors 15 arranged on the industrial robot 18, in order to obtain a suitable reference base for an exact work result for the following automatic working operation. This scanning by the industrial robot 18 could, of course, also be carried out immediately prior to the coupling to the track treatment tool 17.

If desired, it is also possible to carry out a contact-less scan of the track component 23, preferably a rail 13 to be ground, by the sensors 25 during the work operation in order to compare the measuring data thus gained to a target condition stored in the control device 26. If the work operation is composed of several working passes, as in rail grinding, for example, these are repeated automatically until the sensors 25 register that the target condition has been attained. Thus, the program sequence for the industrial robot 18 is automatically changed for achieving an optimal work result. Due to being mobile along the robot guide 20, the industrial robot 18 can be employed without hindrance in the entire work space 9, as desired.

For a work operation of rail drilling, cited here as an example, the rail head is measured via the sensors 25 and a coupled rail drill is moved precisely to the correct position by the industrial robot 18. After drilling has taken place, it is possible to carry out a finalizing quality check with the aid of the sensors 25 and, if needed, also a documenting of the work result by storing the data in connection with a local correlation to the track 7.

This work sequence is naturally also possible in an analogue way for other maintenance operations, such as, for example, rail drilling, rail cutting, shearing a weld bead, track tamping, and so on.

To detach screws, an impact wrench may be used. The latter is mounted on the industrial robot 18 on a 6th motion axis. Via the sensors 25 configured for image recognition, the screw heads are located and loosened. If desired, the detached screws can be picked up and transported away by means of a magnetic gripper fastened to the industrial robot 18, for example. New screws can be placed and tightened quickly.

It is also possible during travel of the maintenance vehicle 1 to measure the track geometry, the gauge or rail gaps with the aid of sensors 25 attached to the industrial robot 18, and to document the results accordingly.

The invention claimed is:

1. A maintenance vehicle, comprising:

on-track undercarriages;

a vehicle frame having ends supported by said on-track undercarriages;

side walls for creating a work space, delimited by said side walls, for working personnel situated on a track, said side walls being disposed on said vehicle frame;

a track treatment tool; and an industrial robot disposed on the maintenance vehicle for treatment of a track section disposed within said work space, said industrial robot having at least three motion axes, media couplings for energy supply and a tool coupling for selective connection to said track treatment tool.

2. The maintenance vehicle according to claim 1, further comprising:

a robot guide; and a first drive, said industrial robot is mounted for displacement by said first drive on said robot guide extending in the longitudinal direction of the maintenance vehicle.

3. The maintenance vehicle according to claim 2, wherein said robot guide is disposed on said vehicle frame and forms an upper border of said work space with regard to a vertical direction.

4. The maintenance vehicle according to claim 1, wherein said industrial robot has sensors, disposed at an end on a coupling side, for contact-less scanning of track components which are accessible within said work space and composed of rails, sleepers and rail fastenings.

5. The maintenance vehicle according to claim 4, further comprising a control device associated with said industrial robot and configured for storing parameters detected by said sensors and characterizing a work quality of the track components treated by said industrial robot.

6. The maintenance vehicle according to claim 5, further comprising a spring balancer displaceable on said vehicle frame in a longitudinal direction of the maintenance vehicle; and wherein said control device is configured for a combined work effort of said industrial robot with said spring balancer for installing or removing the rails.

7. The maintenance vehicle according to claim 1, further comprising a tool shelf, said industrial robot configured for automatic coupling to said track treatment tool, stored for selection on said tool shelf inside said work space, as well as for an automatic energy supply thereof by the media couplings and for a subsequent work assignment taking place automatically in a program mode.

8. The maintenance vehicle according to claim 1, further comprising a second drive, wherein said side walls are configured to be distanced from one another by said second drive in a transverse direction of the maintenance vehicle extending perpendicularly to a longitudinal direction of the maintenance vehicle.

9. A method of carrying out maintenance work on a section of a track which, for creating a secured work space, is delimited by a maintenance vehicle, which method comprises the steps of:

selecting a track treatment tool suitable for a scheduled work operation from a group of tools pre-stored in the secured work space and automatically coupled to an industrial robot both mechanically as well as with regard to a complete energy supply; and contact-less scanning, with an aid of sensors disposed on the industrial robot, a track component to be treated for creating a reference base for a subsequent automatic work operation of the track treatment tool, the track component lying within the workspace during the automatic work operation.

10. The method according to claim 9, which further comprises:

during the subsequent automatic work operation, the contact-less scanning of the track component takes place by the sensors; and comparing obtained measuring data to a stored target condition.

11. The method according to claim 10, wherein the subsequent automatic work operation is composed of several working passes which are automatically repeated until the sensors register that the stored target condition has been attained.

12. The method according to claim 10, wherein the track component being scanned is a rail to be ground.

* * * * *